US007120965B2

(12) United States Patent
Hisano et al.

(10) Patent No.: US 7,120,965 B2
(45) Date of Patent: Oct. 17, 2006

(54) BATTERY-POWERED VACUUM CLEANER AND METHOD OF COOLING BATTERY-POWERED VACUUM CLEANER

(75) Inventors: Katsumi Hisano, Chiba-Ken (JP); Hideo Iwasaki, Kanagawa-Ken (JP); Hideyuki Kanai, Kanagawa-Ken (JP); Motoya Kanda, Kanagawa-Ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 471 days.

(21) Appl. No.: 10/388,636

(22) Filed: Mar. 17, 2003

(65) Prior Publication Data

US 2003/0182758 A1 Oct. 2, 2003

(30) Foreign Application Priority Data

Mar. 29, 2002 (JP) ..... 2002-094906

(51) Int. Cl.
*A47L 11/00* (2006.01)

(52) U.S. Cl. ..... 15/413

(58) Field of Classification Search ..... 15/413, 15/DIG. 1

See application file for complete search history.

(56) References Cited

FOREIGN PATENT DOCUMENTS

| | | | |
|---|---|---|---|
| JP | 7-250788 | | 10/1995 |
| JP | 2001-128901 | | 5/2001 |
| JP | 2002-65535 | * | 3/2002 |
| JP | 2003-38403 | * | 2/2003 |

* cited by examiner

*Primary Examiner*—Gladys JP Corcoran
*Assistant Examiner*—Laura C Guidotti
(74) *Attorney, Agent, or Firm*—Oblon, Spivak, McClelland, Maier & Neustadt, P.C.

(57) ABSTRACT

A battery-powered vacuum cleaner is provided with a battery pack that generates heat and is capable of efficiently cooling the battery pack. The battery pack of the battery-powered vacuum cleaner is cooled by a vacuum cleaner cooling method. The battery-powered vacuum cleaner comprises a battery pack (3) including a plurality of secondary batteries, a battery pack container (2) containing the battery pack, a motor (7) driven for operation by power supplied by the battery pack, a fan (5) driven by the motor to suck air, a dust cup (9) for separating dust from air sucked therein by the fan and storing the dust separated from the sucked air, a housing (1) containing the battery pack container, the motor, the fan and the dust cup, and provided with a first suction opening (30) through which external air is sucked, a first airflow duct (32) for guiding the air sucked in by the fun through the dust cup to the motor, and a second airflow duct (36), for guiding air for cooling the battery pack through the battery pack, joined to the first airflow duct at a junction (34) on the upstream side of the fan.

5 Claims, 7 Drawing Sheets

BATTERY-POWERED VACUUM CLEANER AND METHOD OF COOLING BATTERY-POWERED VACUUM CLEANER

CROSS-REFERENCE TO RALATED APPLICATIONS

This application is based upon and claims the benefit of priority from the prior Japanese Patent Applications No. 2002-94906, filed on Mar. 29, 2002; the entire contents of which are incorporated herein by reference

BACKGROUND OF THE INVENTION

1. Field of the Invention

The present invention relates to a battery-powered vacuum cleaner powered by a battery, such as a lithium ion secondary battery or a nickel metal hydride secondary battery, and a method of cooling the battery-powered vacuum cleaner. More particularly, the present invention relates to a heat radiating structure for a battery pack, and a method of cooling the battery pack.

2. Description of the Related Art

FIG. 13A and FIG. 13B are schematic sectional views of a conventional vacuum cleaner. A battery pack container 2 formed in a casing (housing) 1 of the vacuum cleaner. The battery pack container 2 is formed of a concave wall continuous with the casing 1, and a removable cover fastened with a screw to facilitate changing a battery pack 3. The battery pack 3 contained in the battery pack container 2 is formed by bundling a plurality of secondary batteries in a heat-shrinkable tube. The battery pack 3 supplies power to a motor 7 having an output shaft holding a fan 5, and a control circuit for controlling the motor 7. The battery pack 3 generates heat due to the internal resistances of the batteries 4 and the resistances of the wires connecting the batteries 4 when the vacuum cleaner operates. To drive the motor 7, the battery pack 3 needs to supply a high current and generates heat energy at a high rate. Excessive temperature rise in the batteries 4 must be avoided to operate the batteries 4 at high charge-discharge efficiency, i.e., to discharge the largest possible amount of energy stored in the batteries 4. Therefore the battery pack 3 generating heat must be cooled. A side wall, on the side of a dust cup 9, of the battery pack container 2 is provided with slits 10 to facilitate cooling the battery pack 3. Air used for sucking dust is guided to the motor 7 to cool the motor 7, and then the air passed the motor 7 is guided so as to flow through the vicinity of the battery pack container 2. The battery pack 3 is formed by bundling the cylindrical secondary batteries 4 in the heat-=shrinkable tube, and wiring lines are extended fro the battery pack 3. The air containing dust and sucked through a hose 14 by the fan 5 is guided into the dust cup 9, the air flows through a filter 17 outside the dust cup 9, and the thus filtered air is guided to the vicinity of the motor 7 to air-cool the coils and the components of the motor 7. The air used for air-cooling the motor 7 is discharged outside through a discharge openings 12 formed in an end all of the housing 1. Wheels 19 and 20 are attached to the bottom wall of the casing 1.

In this conventional vacuum cleaner, the air sucked by the fan 5 and cooled the motor 7 is guided to the battery pack container 2 to cool the battery pack 3. The battery pack 3 cannot be efficiently cooled because the air heated by heat generated by the motor 7 is used for cooling the battery pack 3.

SUMMARY OF THE INVENTION

Accordingly, it is an object of the present invention to solve those problems in the conventional techniques and to provide a battery-powered vacuum cleaner provided with a battery pack that generates heat, and capable of efficiently cooling the battery pack.

According to a first aspect of the present invention, a battery-powered vacuum cleaner comprises: a battery pack including a plurality of secondary batteries; a battery pack container containing the battery pack; a motor driven by power supplied by the battery pack; a fan driven by the motor to suck air; a dust cup for separating dust from air sucked therein by the fan and storing the dust separated from the sucked air; a housing containing the battery pack container, the motor, the fan and the dust cup, and provided with a first suction opening through which external air is sucked; a first airflow duct for guiding the air sucked in by the fun through the dust cup to the motor; and a second airflow duct, for guiding air for cooling the battery pack through the battery pack, joined to the first airflow duct at a junction on the upstream side of the fan.

Preferably, the housing is provided with a second suction opening to suck in external air there through, and air sucked in through the second suction opening flows through the second airflow duct.

In the battery-powered vacuum cleaner according to the present invention, a flow regulating valve is placed in the second airflow duct to regulate the flow of air through the junction of the first and the second airflow duct into the first airflow duct.

In the battery-powered vacuum cleaner according to the present invention, the second airflow duct branches from the first airflow duct at a junction on the upstream side of the dust cup.

In the battery-powered vacuum cleaner according to the present invention, the second airflow duct branches from the first airflow duct at a junction on the downstream side of the dust cup In the battery-powered vacuum cleaner according to the present invention, a third airflow duct is joined to the first airflow duct on the downstream side of the fan to return air flowed through the first airflow duct to the first suction opening.

In the battery-powered vacuum cleaner according to the present invention, the housing is provided with a second suction opening to suck in external air, air sucked in through the second suction opening flows through the second airflow duct, and a discharge duct for discharging air at a discharge rate corresponding to a suction rate at which external air is sucked in through the second suction opening branches from the third airflow duct.

In the battery-powered vacuum cleaner according to the present invention, an end of the second airflow duct joined to the first airflow duct at the junction is flush with the inner surface of the first airflow duct.

In the battery-powered vacuum cleaner according to the present invention, the junction is on the upper side of the first airflow duct with respect to the direction of gravitation in a working state.

The second airflow duct is provided with a projection projecting into the first airflow duct at its upstream end at the junction.

In the battery-powered vacuum cleaner according to the present invention, the second airflow duct has a greatly sloping part projecting into the first airflow duct at a large angle to the direction of air flow at the junction, and a slightly sloping part extending from a downstream end of the greatly sloping part at a small angle to the direction of air flow in the first airflow duct and having an open end opening downstream with respect to the direction of air flow.

In the battery-powered vacuum cleaner according to the present invention, a filter for filtering air sucked in through the second suction opening is placed in the second airflow duct.

According to a second aspect of the present invention, a vacuum cleaner cooling method of cooling a battery-powered vacuum cleaner, which comprises a battery pack including a plurality of secondary batteries, a battery pack container containing the battery pack, a motor driven for operation by power supplied by the battery pack, a fan driven by the motor to suck external air, a dust cup for separating dust from air sucked therein by the fan and storing the dust separated from the sucked air, a housing containing the battery pack container, the motor, the fan and the dust cup, and provided with first and second suction openings through which external air is sucked, a first airflow duct for guiding the air sucked in by the fun through the dust cup to the motor, and a second airflow duct, for guiding air for cooling the battery pack through the battery pack, joined to a part, on the upstream side of the fan, of the first airflow duct; comprises: the steps of sucking external air in through the first suction opening and guiding the sucked external air through the dust cup and the first air flow duct to the motor; and sucking external air in through the second suction opening by the agency of the fan, guiding the sucked external air so as to flow through the vicinity of the battery pack to cool the battery pack, guiding the air used for cooling the battery pack through the second airflow duct to a position on the upstream side of the fan and making the air flow into the air flowing through the first airflow duct.

Since the vacuum cleaner cooling method according to the present invention uses the air flowing through the second airflow duct extending via the battery pack and joining to the first airflow duct on the upstream side of the fan and not used for cooling the motor for cooling the battery pack, the battery pack on the upstream side of the junction in the second airflow duct can be efficiently cooled by the air not heated and not used for cooling the motor.

DESCRIPTION OF THE PREFERRED EMBODIMENTS

Preferred embodiments of the present invention will be described with reference to the accompanying drawings.

Figure 2:
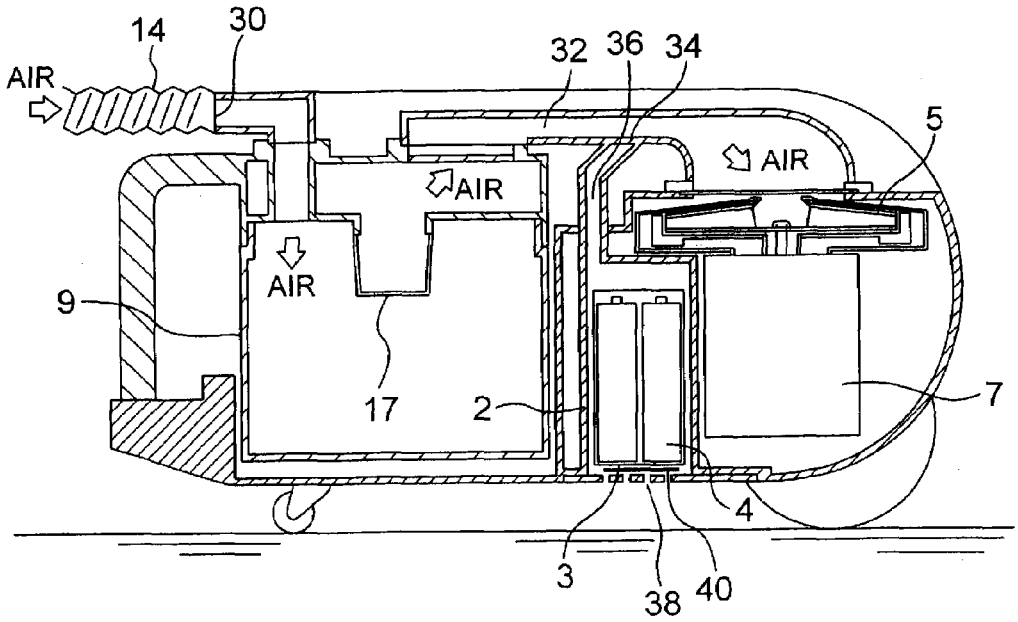
FIG. 2 is a longitudinal sectional view of the battery-powered vacuum cleaner in the first embodiment.

Referring to FIG. 2 showing a battery-powered vacuum cleaner in a first embodiment according to the present invention in a schematic sectional view, the battery-powered vacuum cleaner comprises a battery pack 3 formed by bundling a plurality of secondary batteries 4 and electrically connecting the secondary batteries 4 by wires, a battery pack container 2 containing the battery pack 3, a motor 7 driven by power supplied by the battery pack 3, a fan 5 driven by the motor 7 to suck air, a dust cup 9 for separating dust from air sucked therein by the fan 5 and storing the dust separated from the sucked air, a housing 1 containing the battery pack container 2, the motor 7, the fan 5 and the dust cup 9, and provided with a first suction opening 30 through which external air is sucked into the housing 1, a first airflow duct 32 for carrying the air sucked in by the fun 5 through the dust cup 9 to the motor 7, and a second airflow duct 36, for carrying air for cooling the battery pack 3 through the battery pack 3, joined to the first airflow duct 32 at a joining junction 34 on the upstream side of the fan 5.

Figure 1:
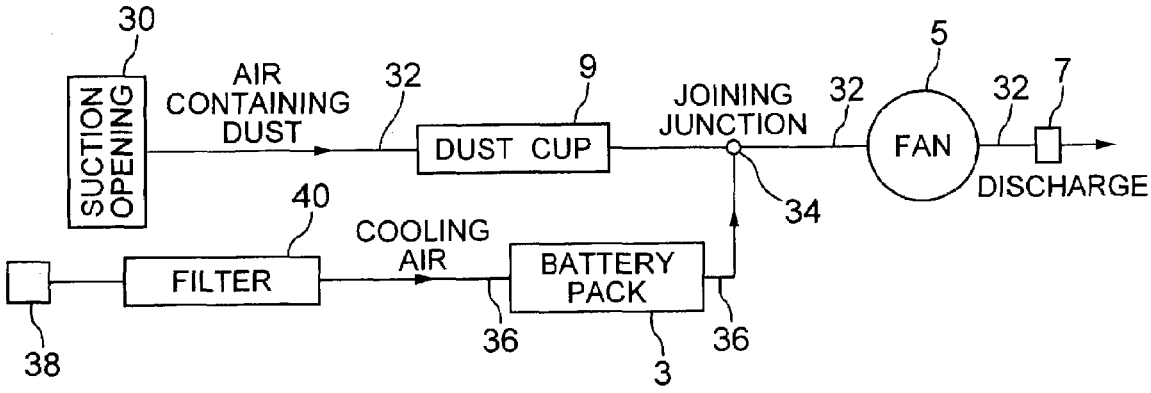
FIG. 1 is a block diagram of a battery-powered vacuum cleaner in a first embodiment according to the present invention.

FIG. 1 is a block diagram illustrating the relation between the first airflow duct 32 and the second airflow duct 36.

Air containing dust and sucked by the agency of the fan 5 through a hose 14 connected to the first suction opening 30 flows into the dust cup 9. Then, the air flows through a filter 17 outside the dust cup 9, and is carried by the first airflow duct 32 to the vicinity of the motor 7 to cool the coils and the components of the motor 7. The air used for cooling the motor 7 is discharged outside through a discharge opening, not shown, formed in an end part of the housing 1. The first airflow duct 32 has sections extending between the suction opening 30 and the dust cup 9, between the dust cup 9 and the fan 5, and between the fan 5 and the discharge opening, not shown, respectively.

A second suction opening 38 is formed in a part, in the vicinity of the battery pack container 2, of the bottom wall of the casing 1. External air is sucked through the second suction opening 38 into the housing 1. The second airflow duct 36 is connected to the upper wall of the battery pack container 2. Air for cooling the battery pack 3 is sucked through the second suction opening 38 by the agency of the fan 5. The air sucked through the second suction opening 38 is filtered by a filter 40 placed over the second suction opening 38. Then, the air flows through openings formed in the battery pack container 2 into the battery pack container 2, and flows through the battery pack container 2 along the battery pack 3 to cool the battery pack 3. The air thus flowed vertically upward through the battery pack container 2 flows into and through the second airflow duct 36 connected to the upper end of the battery pack container 2, and flows through the joining junction 34 of the first airflow duct 32 and the second airflow duct 36 into the first airflow duct 32. The second airflow duct 36 has sections extending between the second suction opening 38 and the lower end of the battery pack container 2, between the lower end of the battery pack container 2 and the battery pack 3, between the battery pack 3 and the upper end of the battery pack container 2, and between the upper end of the battery pack container 2 and the joining junction 34, respectively.

Examples of the joining junction 34 of the first airflow duct 32 and the second airflow duct 36 will be described with reference to FIGS. 3 to 5.

Figure 3:
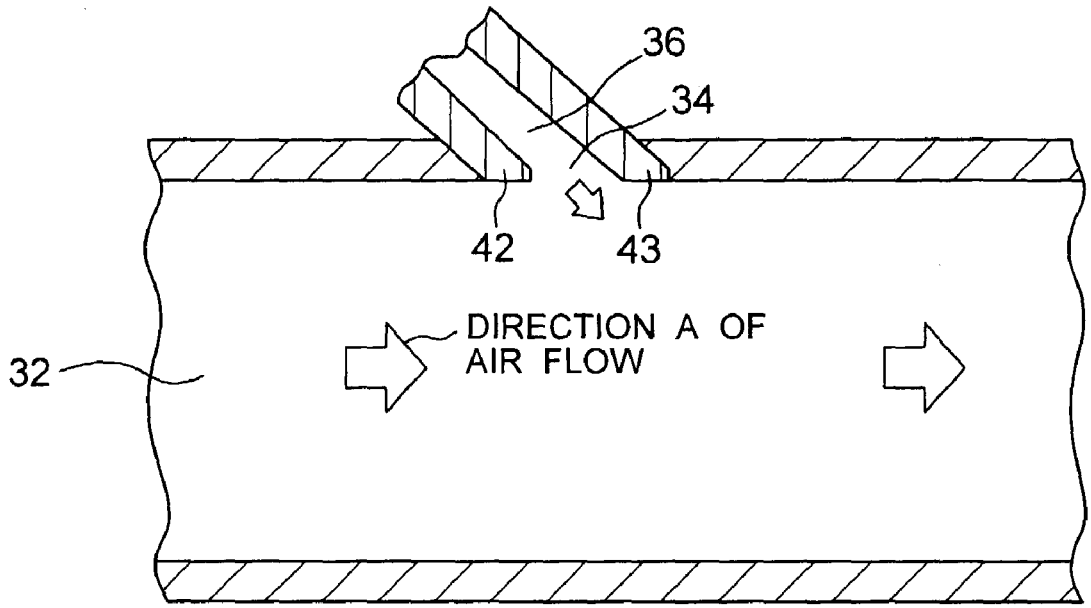
FIG. 3 is a sectional view of the junction of first and second airflow ducts in a first example in the battery-powered vacuum cleaner in the first embodiment.

FIG. 3 shows a joining junction 34 in a first example. The second airflow duct 36 slopes at an inclination to the direction A of air flow in the first airflow duct 32 so that the second airflow duct 36 delivers air into the first airflow duct 32 so that the air flows substantially in the direction A of air flow in the first airflow duct 32. Edges of end parts 42 and 43 of the second airflow duct 36 at the joining junction 34 are flush with the inner surface of a wall of the first airflow duct 32.

When the battery-powered vacuum cleaner is in operation, the joining junction 34 is on the upper side of the first airflow duct 32 with respect to the direction of gravity.

Since the second airflow duct 36 thus slopes at an inclination to the direction A of air flow, the air delivered by the second airflow duct 36 into the first airflow duct 32 is drawn by the air flowing through the first airflow duct 32 and is able to merge smoothly into the air flowing through the first airflow duct 32. Consequently, air can be made to flow through the second airflow duct 36 by small energy. Since the edges of the end parts 42 and 43 are flush with the inner surface of the wall of the first airflow duct 32, generation of complicated air currents in the vicinity of the joining junction 34 can be avoided and the reverse flow of dust into the second airflow duct 36 can be avoided. Since the joining junction 34 is on the upper side of the first airflow duct 32 with respect to the direction of gravity in a state where the battery-powered vacuum cleaner is in operation, dust stagnating around the joining junction 34 can be made to fall by gravity and can be easily discharged outside.

Figure 4:
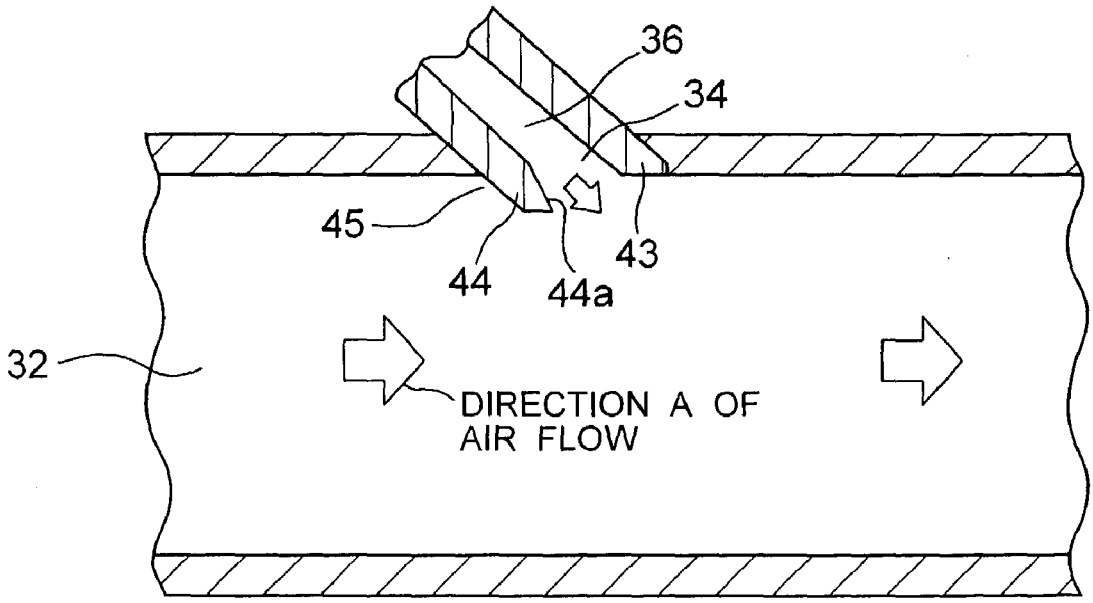
FIG. 4 is a sectional view of the junction of first and second airflow ducts in a second example in the battery-powered vacuum cleaner in the first embodiment.

FIG. 4 shows a joining junction 34 in a second example. The second airflow duct 36, similarly to the second airflow duct 36 shown in FIG. 3, slopes at an inclination to the direction A of air flow in the first airflow duct 32. An upstream end part 44 of the second airflow duct 36 projects into the first airflow duct 32. The edge 44*a* of the upstream end part 44 expands downstream.

Since the upstream end part 44 projects into the first airflow duct 32, pressure in a region 45 on the upstream side of the upstream end part 44 is high and pressure in the joining junction 34 is low relative to that in the region 45. Consequently, the air flowing through the second airflow duct 36 toward the joining junction 34 can be effectively drawn into the first airflow duct 32. The second airflow duct 36 has a downstream end part 43 having an end edge flush with the inner surface of the wall of the first airflow duct 32. Even if the end edge of the downstream end part 43 projects slightly from or lies slightly behind the inner surface of the wall of the first airflow duct 32 due to errors in manufacturing processes, pressure in the vicinity of the downstream end part 43 is low because the upstream end part 44 projects into the first airflow duct 32. Therefore, stagnation of dust in the vicinity of the downstream end part 43 can be avoided.

Figure 5:
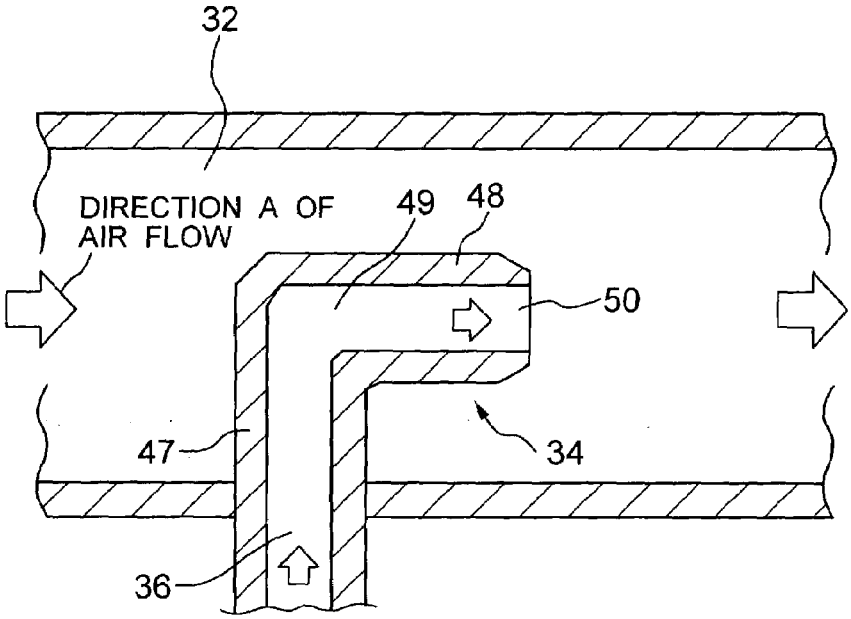
FIG. 5 is a sectional view of the junction of first and second airflow ducts in a third example in the battery-powered vacuum cleaner in the first embodiment.

FIG. 5 shows a joining junction 34 in a third example. The second airflow duct 36 has a greatly sloping part 47 projecting into the first airflow duct 32 at a large angle to the direction A of air flow at the joining junction 34, and a slightly sloping part 48 extending from a downstream end of the greatly sloping part 47 at a small angle to the direction of air flow in the first airflow duct 32 and having an open end 50 opening downstream with respect to the direction A of air flow. An end part of the wall of the greatly sloping part 47 and an end part of the wall around the opening 50 of the slightly sloping part 48 are tapered to reduce resistance against the air flow.

Pressure in a downstream region 49 of a passage defined by the greatly sloping part 47 is high because the velocity of air flow in the downstream region 49 is low. Pressure in the vicinity of the opening 50 is low. Consequently, the air flowing through the second airflow duct 36 can be efficiently delivered through the opening 50.

The battery-powered vacuum cleaner in the first embodiment described above in connection with FIGS. 1 to 5 is provided with the second airflow duct 36 joined to the first airflow duct 32 at the joining junction 34 on the upstream side of the motor 7 to carry air for cooling the battery pack 3. The battery pack 3 can be efficiently cooled by air sucked in by the agency of the fan 5 into the second airflow duct 36 and not used for cooling the motor 7.

Figure 6:
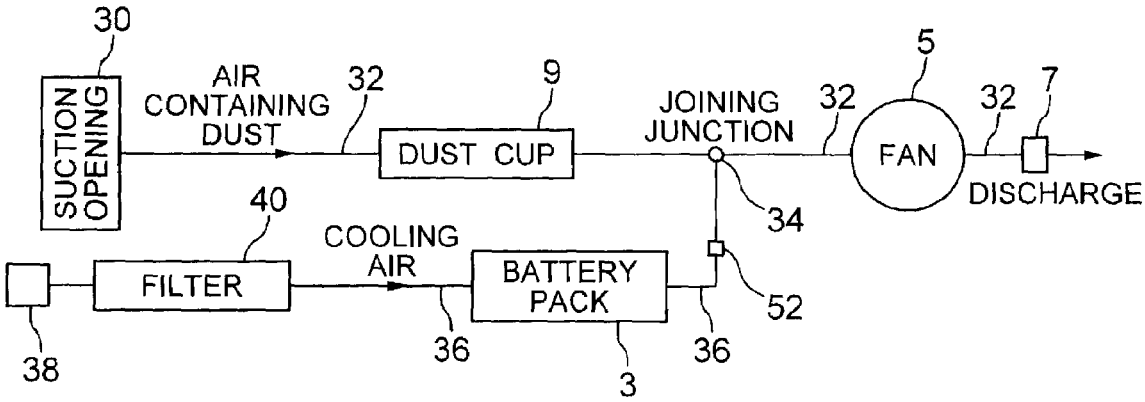
FIG. 6 is a block diagram of a battery-powered vacuum cleaner in a second embodiment according to the present invention.

A battery-powered vacuum cleaner in a second embodiment according to the present invention will be described with reference to FIG. 6. The battery-powered vacuum cleaner in the second embodiment comprises, in addition to part similar to those of the battery-powered vacuum cleaner in the first embodiment, a flow regulating valve 52 for regulating the flow rate of air flowing through a second airflow duct 36 into a joining junction 34 of a first airflow duct 32 and the second airflow duct 36. The flow regulating valve 52 is placed in a section, between a battery pack 3 and the joining junction 34, of the second airflow duct 36.

The battery-powered vacuum cleaner in the second embodiment provided with the flow regulating valve 52 placed in the second airflow duct 36 has the following effects.

At the start of the battery-powered vacuum cleaner, the battery pack 3 is not heated, and hence the flow regulating valve 52 is closed to use all the suction of a fan 5 is applied to sucking air into the first airflow duct 32. The flow regulating valve 52 is opened after the battery pack 3 has been heated to some extent to make air flow through the second airflow duct 36 in order that the battery pack 3 is air-cooled. The degree of opening of the flow regulating valve 52 may be adjusted according to the degree of heating of the battery pack 3.

Electric energy that can be supplied to the battery-powered vacuum cleaner can be properly distributed to collecting dust by making air flow through the first airflow duct 32 and cooling the battery pack 3 by making air flow through second airflow duct 36.

A battery-powered vacuum cleaner in a third embodiment according to the present invention will be described with reference to FIG. 7.

Figure 7:
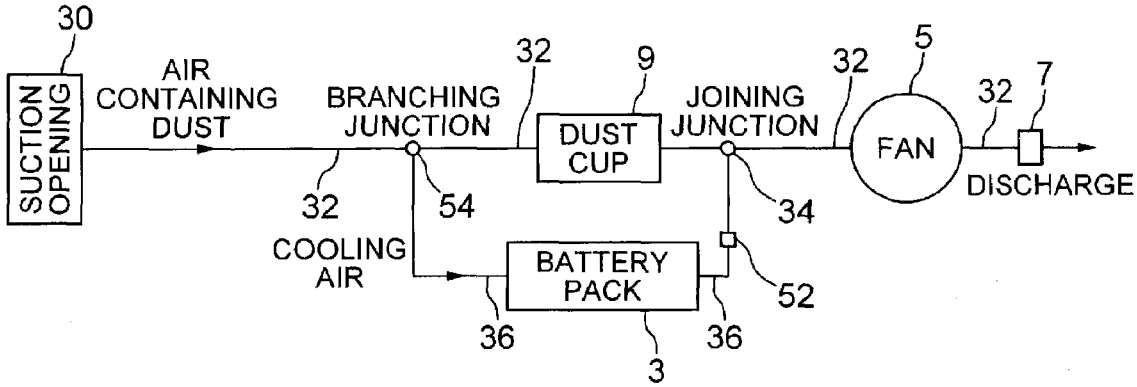
FIG. 7 is a block diagram of a battery-powered vacuum cleaner in a third embodiment according to the present invention.

Referring to FIG. 7, a second airflow duct 36 branches from a first airflow duct 32 at a branching joining junction 34 on the upstream side of a dust cup 9 and joins to the first airflow duct 32 at a joining junction 54 on the downstream side of the dust cup 9. A battery pack 3 is placed in the second airflow duct 36 extending between the branching junction 54 and the joining junction 34. A flow regulating valve 52 is placed, similarly to the flow regulating valve 52 shown in FIG. 6, in the second airflow duct 36.

In the battery-powered vacuum cleaner in the third embodiment, the second airflow duct 36 branches from the first airflow duct 32 at the branching junction 54 on the upstream side of the dust cup 9. Therefore, air is able to flow at a proper flow rate through the second airflow duct 36 without being affected by the resistance of the dust cup 9 against air flow even if a large amount of dust is accumulated in the dust cup 9 and air is able to flow at a low flow rate through the dust cup 9, so that the battery pack 3 can be surely air-cooled. Since the second airflow duct 36 branches from the first airflow duct 32 at the branching junction 54, the battery-powered vacuum cleaner needs only a suction opening 30 and does not need any suction opening like the suction opening 38 shown in FIG. 38.

A battery-powered vacuum cleaner in a fourth embodiment according to the present invention will be described with reference to FIG. 8.

Figure 8:
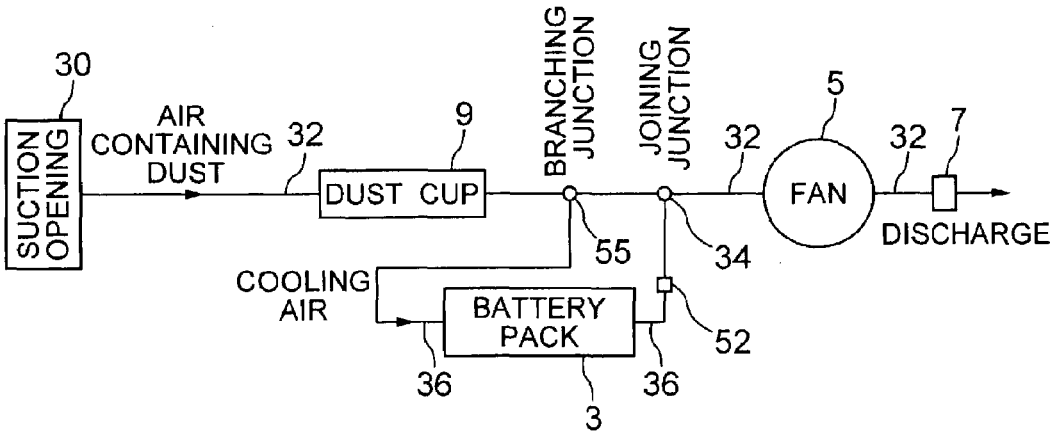
FIG. 8 is a block diagram of a battery-powered vacuum cleaner in a fourth embodiment according to the present invention.

Referring to FIG. 8, a second airflow duct 36 branches from a first airflow duct 32 at a branching junction 55 on the downstream side of a dust cup 9 and joins to the first airflow duct 32 at a joining junction 34 on the downstream side of the branching junction 55. A battery pack 3 is placed in the second airflow duct 36 extending between the branching junction 55 and the joining junction 34.

Figure 11:
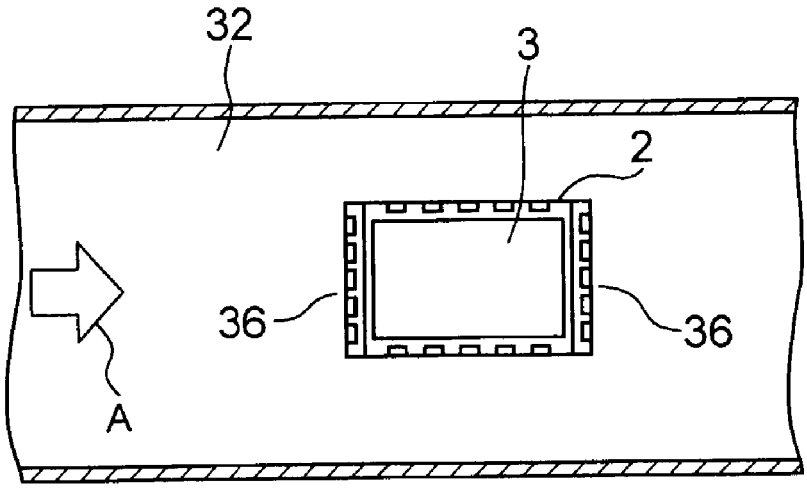
FIG. 11 is a fragmentary longitudinal sectional view of assistance in explaining the relation between first and second airflow ducts in the fourth embodiment.

The battery pack 3 may be placed in the second airflow duct 36 of a small size extending between the branching junction 55 and the joining junction 34 in the first airflow duct 32 of a large size as shown in FIG. 11.

Since the branching junction 55 is on the downstream side of the dust cup 9 in the battery-powered vacuum cleaner in the fourth embodiment, air flowed through the dust cup 9 is used for cooling the battery pack 3. Since dust is removed from the cooling air by the dust cup 9, the cooling air is superior in cleanliness to the cooling air flowing through the second airflow duct 36 branching from the first airflow duct 32 at the branching junction on the upstream side of the cooling cup 9 as shown in FIG. 7. The battery pack 3 can be efficiently cooled by air not heated by the motor 7, for example, simply by placing the battery pack 3 in the first airflow duct 32.

A battery-powered vacuum cleaner in a fifth embodiment according to the present invention will be described with reference to FIG. 8.

Figure 9:
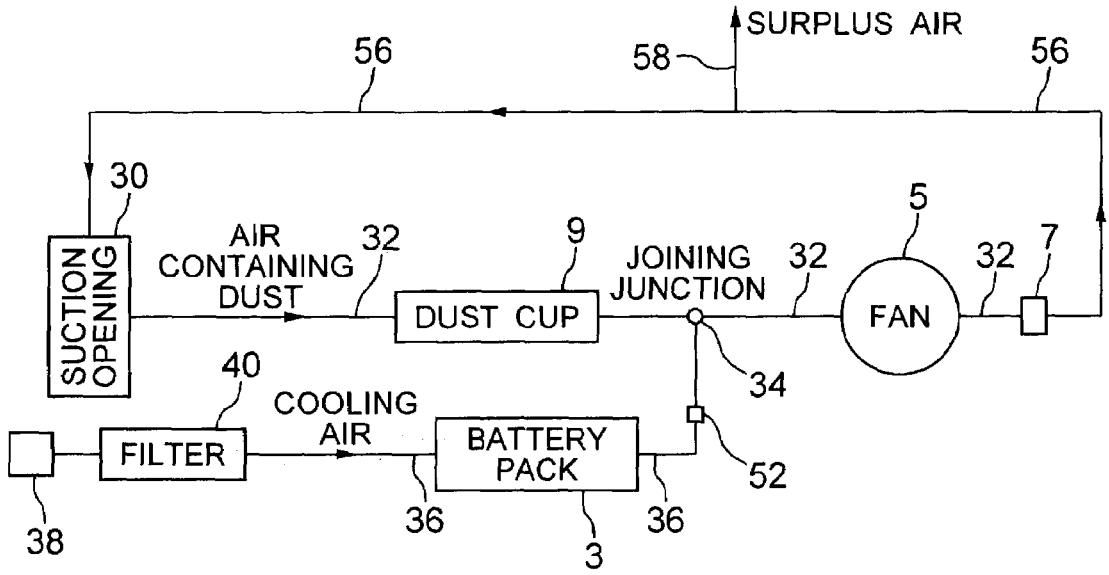
FIG. 9 is a block diagram of a battery-powered vacuum cleaner in a fifth embodiment according to the present invention.
Figure 12:
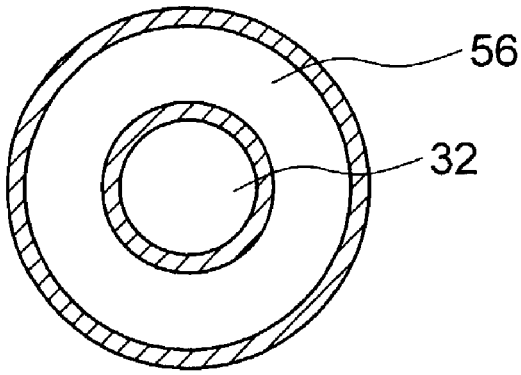
FIG. 12 is a cross-sectional view of assistance in explaining the relation between first and third airflow ducts in the fifth embodiment.
Figure 13A:
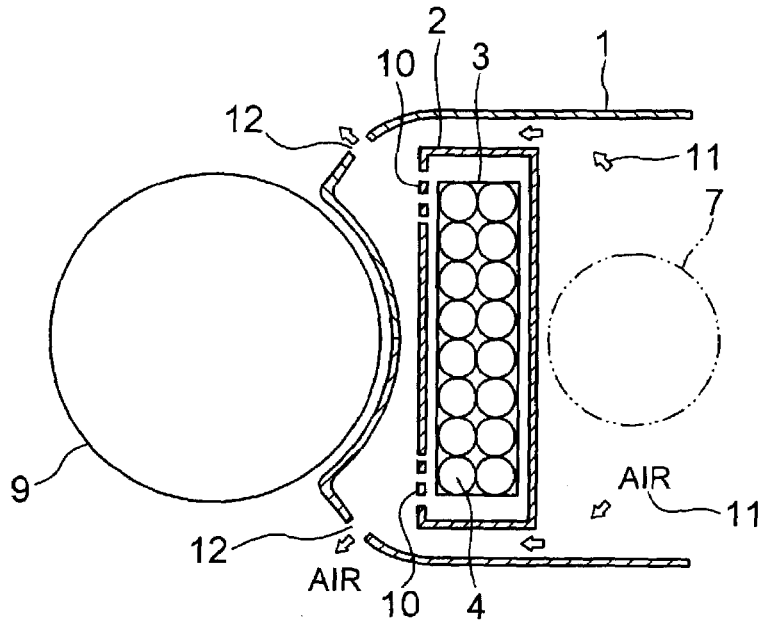
FIGS. 13A and 13B are a cross-sectional view and a longitudinal sectional view, respectively, of a conventional battery-powered vacuum cleaner.
Figure 13B:
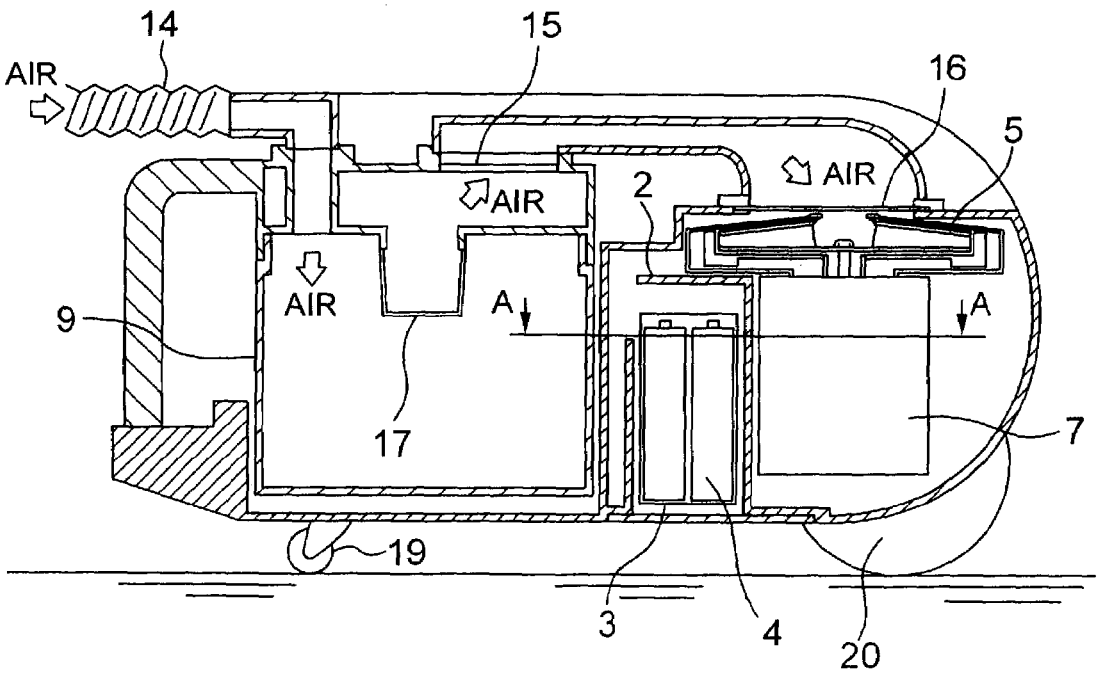

The battery-powered vacuum cleaner shown in FIG. 9 is of a circulation type differing from the battery-powered vacuum cleaner shown in FIG. 1 in that sucked air is not discharged and is circulated. Air sucked in through a suction opening 30 by a fan 5 is returned through a third airflow duct 56 to the suction opening 30. The third airflow duct 56 extends between a part, on the downstream side of the fan 5, of a first airflow duct 32 and the suction opening 30. For example, the third airflow duct 56 may be formed coaxially with the first airflow duct 32 so as to surround the first airflow duct 32 as shown in FIG. 12. The direction of air flow in the first airflow duct 32 and that of air flow in the third airflow duct 56 are opposite to each other.

A second airflow duct 36 of the fifth embodiment, similarly to that shown in FIG. 1, extends from a second suction opening 38 through a battery pack container 2 and a battery pack 3 to a joining junction 34.

A discharge duct 58 branches from the third airflow duct 56 to discharge surplus air sucked in through the second suction opening 38.

An amount of air corresponding to that of air sucked through the second suction opening 38 to cool the battery pack 3 can be discharged through the discharge duct 58. Thus, the battery pack 3 of the battery-powered vacuum cleaner of a circulation type can be efficiently cooled by air not heated by a motor 7.

A battery-powered vacuum cleaner in a sixth embodiment according to the present invention will be described with reference to FIG. 10.

Figure 10:
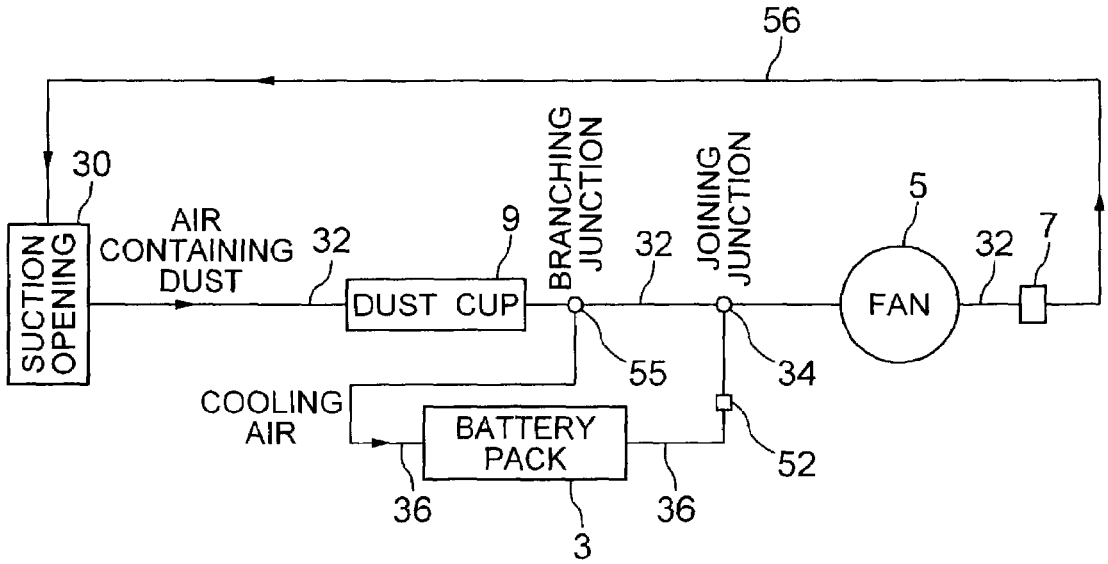
FIG. 10 is a block diagram of a battery-powered vacuum cleaner in a sixth embodiment according to the present invention.

The battery-powered vacuum cleaner shown in FIG. 10 is of a circulation type differing from the battery-powered vacuum cleaner shown in FIG. 8 in that sucked air is not discharged and is circulated. Air sucked in through a suction opening 30 by a fan 5 is returned through a third airflow duct 56 to the suction opening 30. The third airflow duct 56 extends between a part, on the downstream side of the fan 5, of a first airflow duct 32 and the suction opening 30. Any discharge duct corresponding to the discharge duct 58 shown in FIG. 9 does not branch from the third airflow duct 56. The battery-powered vacuum cleaner has a second airflow duct 36 similar to that shown in FIG. 8.

The battery-powered vacuum cleaner in the sixth embodiment sucks in air only through the suction opening 30. Thus, the battery-powered vacuum cleaner in the sixth embodiment is of a perfect circulation type that returns all the air sucked in through the suction opening 30 through the third airflow duct 56 to the suction opening 30. A battery pack 3 can be efficiently cooled by air not heated by a motor 7. The discharge duct 58 as shown in FIG. 9 is unnecessary.

As apparent fro the foregoing description, according to the present invention, the battery pack can be efficiently cooled by air not heated by the motor because the second airflow duct branches from the first airflow duct at the branching junction on the upstream side of the fan.

What is claimed is:

1. A battery-powered vacuum cleaner comprising:

a battery pack including a plurality of secondary batteries;

a battery pack container containing the battery pack;

a motor driven for operation by power supplied by the battery pack;

a fan driven by the motor to suck air;

a dust cup for separating dust from air sucked therein by the fan and storing the dust separated from the sucked air;

a housing containing the battery pack container, the motor, the fan and the dust cup, and provided with a first suction opening through which external air is sucked;

a first airflow duct for guiding the air sucked in by the fan through the dust cup to the motor; and a second airflow duct, for guiding air for cooling the battery pack through the battery pack, joined to the first airflow duct at a junction on an upstream side of the fan;

wherein a flow regulating valve is placed in the second airflow duct to regulate flow of air through the junction of the first and the second airflow duct into the first airflow duct.

2. A battery-powered vacuum cleaner comprising:

a battery pack including a plurality of secondary batteries;

a battery pack container containing the battery pack;

a motor driven for operation by power supplied by the battery pack;

a fan driven by the motor to suck air;

a dust cup for separating dust from air sucked therein by the fan and storing the dust separated from the sucked air;

a housing containing the battery pack container, the motor, the fan and the dust cup, and provided with a first suction opening through which external air is sucked;

a first airflow duct for guiding the air sucked in by the fan through the dust cup to the motor; and a second airflow duct, for guiding air for cooling the battery pack through the battery pack, joined to the first airflow duct at a junction on an upstream side of the fan;

wherein a third airflow duct is joined to the first airflow duct on a downstream side of the fan to return air flowed through the first airflow duct to the first suction opening.

3. The battery-powered vacuum cleaner according to claim 2, wherein the housing is provided with a second suction opening to suck in external air, air sucked in through the second suction opening flows through the second airflow duct, and a discharge duct for discharging air at a discharge rate corresponding to a suction rate at which external air is sucked in through the second suction opening branches from the third airflow duct.

4. The battery-powered vacuum cleaner according to claim 3, wherein a filter for filtering air sucked in through the second suction opening is placed in the second airflow duct.

5. A battery-powered vacuum cleaner comprising:

a battery pack including a plurality of secondary batteries;

a battery pack container containing the battery pack;

a motor driven for operation by power supplied by the battery pack;

a fan driven by the motor to suck air;

a dust cup for separating dust from air sucked therein by the fan and storing the dust separated from the sucked air;

a housing containing the battery pack container, the motor, the fan and the dust cup, and provided with a first suction opening through which external air is sucked;

a first airflow duct for guiding the air sucked in by the fan through the dust cup to the motor; and a second airflow duct, for guiding air for cooling the battery pack through the battery pack, joined to the first airflow duct at a junction on an upstream side of the fan;

wherein the second airflow duct has a greatly sloping part projecting into the first airflow duct at a large angle to a direction of air flow at the junction, and a slightly sloping part extending from a downstream end of the greatly sloping part at a small angle to the direction of air flow in the first airflow duct and having an open end opening downstream with respect to the direction of air flow.

* * * * *